US005203553A

United States Patent [19]

Chiang

[11] Patent Number: 5,203,553

[45] Date of Patent: Apr. 20, 1993

[54] AUTOMATIC DOCUMENT FEEDER

[75] Inventor: Ming-Tong Chiang, Hsinchu, Taiwan

[73] Assignee: Industrial Technology Research Institute, Hisinchu, Taiwan

[21] Appl. No.: 853,822

[22] Filed: Mar. 19, 1992

[51] Int. Cl.[5] ..... B65H 5/00; B65H 3/06

[52] U.S. Cl. ..... 271/10; 271/116; 271/270

[58] Field of Search ..... 271/10, 114, 116, 270; 400/624, 629

[56] References Cited

U.S. PATENT DOCUMENTS 2,762,623 9/1956 Uthenwoldt et al. ..... 271/116
3,961,786 6/1976 Yanker ..... 271/10 X
4,032,135 6/1977 Ruenzi ..... 271/116
4,529,187 7/1985 Einem et al. ..... 271/116 X
4,927,130 5/1990 Tanaka et al. ..... 271/10
5,141,217 8/1992 Lim et al. ..... 271/270 X

*Primary Examiner*—D. Glenn Dayoan
*Assistant Examiner*—Boris Milef
*Attorney, Agent, or Firm*—Fish & Richardson

[57] ABSTRACT

Disclosed is the structure of a clutch mechanism of an automatic document feeder of a fax machine. The structure is fully mechanical, without any electromagnetic member. A combination of springs and pulleys are utilized to substitute for the conventional electromagnetic clutch and single directional bearings.

1 Claim, 8 Drawing Sheets

AUTOMATIC DOCUMENT FEEDER

FIELD OF THE INVENTION

The present invention relates to the mechanism of an automatic document feeder, especially to the mechanism of the automatic document feeder of a fax machine, which uses a mechanical mechanism instead of a electromechanical mechanism.

BACKGROUND OF THE INVENTION

The working process of the fax machine in sending out documents generally includes the steps as follows:

1) Separate the first page from the remaining documents;

2) Feed the first page into scanning means;

3) Scan the first page at a predetermined speed and send out a serious of codes representing the graphical data of the page according to communication protocols;

4) Repeat the above steps until no documents remains.

Most fax machines use a combination of an electromagnetic clutch and a single-directional bearing to achieve the purpose of separating and feeding the document papers for accurately scanning the graphical data. However, this increases manufacturing cost of the fax machines, since the electromagnetic clutch and the single-directional bearing are expensive and difficult to assemble.

SUMMARY OF THE INVENTION

It is therefore an object of this invention to provide a structure for the automatic document feeder of the fax machine without the electromagnetic clutch or the single-directional bearing.

Another object of this invention is to provide a structure for the automatic document feeder of the fax machine that is easy to assemble.

These objects of the present invention are fulfilled by providing an automatic document feeder of a fax machine to transporting document sheets from a document tray to an outlet tray, during which the graphical data on the document sheets is scanned and transmitted. The automatic document feeder comprises a feeding roller, disposed downstream the document tray, for urging the document sheets downstream; a dividing roller, disposed downstream said feeding roller, for urging one of the document sheets downstream, said dividing roller having a first outer periphery; an driving shaft, coaxially disposed with said dividing roller; a scanning roller, disposed downstream said dividing roller, for urging said one of the document sheets downstream, while said one of the document sheets is scanned, said scanning roller having a second outer periphery; an outlet roller, disposed downstream said scanning roller and upstream the outlet tray for transporting said one of the document sheets to the outlet tray; means for urging said driving shaft and said scanning roller and said outlet roller, the tangential speed of said second outer periphery of said scanning roller being greater than the tangential speed of said first outer periphery of said dividing roller; and a clutch, connecting said shaft and said feeding roller and said dividing roller, for controlling the rotation of said feeding roller and said dividing roller, said clutch comprising a first pulley, a second pulley, a third pulley, a fourth pulley, a first coil spring, a second coil spring, a first belt and a second belt, said first pulley being mounted on said driving shaft, said second pulley being mounted on said dividing roller, said first coil spring being wound in the opposite direction of the rotational direction of said driving shaft, one end of said first coil spring being sleeved on said first pulley and the other end being sleeved on said second pulley, said third pulley being rotatably mounted on said feeding roller, said fourth pulley being rotatably mounted on said feeding roller, said fourth pulley having a enlarged hole at one end of said fourth pulley, said second coil spring being wound in the opposite direction of the rotational direction of said third pulley, one end of said second coil spring being sleeved on said third pulley and the other end being received in said enlarged hole of said fourth pulley, said first belt being mounted on said first pulley and said third pulley, said second belt being mounted on said second pulley and said fourth pulley, said driving shaft and said scanning roller and said outlet roller being urged to rotate by said urging means, said first pulley being driven by said driving shaft, said first coil spring being urged to retract and clamp said first pulley and said second pulley by said first pulley, said dividing roller being urged to rotate by said first coil spring, said third pulley being driven by said first pulley via said first belt, said second coil spring being urged to retract and clamp said third pulley and said feeding roller for further driving said feeding roller by said third pulley, said feeding roller urging said one of the document sheets downstream, said dividing roller urging said one of the document sheets downstream, said scanning roller urging said one of the document sheets downstream, then said dividing roller and said second pulley being driven at a greater rotational speed by said scanning roller via said one of the document sheets, therefore said first coil spring being urged to loosen and release said first pulley and said second pulley by said second pulley, said fourth pulley being driven at a greater rotational speed by said second pulley via said second belt, said second coil spring being urged to loosen and release said third pulley and said feeding roller by said fourth pulley for stopping said feeding roller.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE EMBODIMENTS

Figure 1:
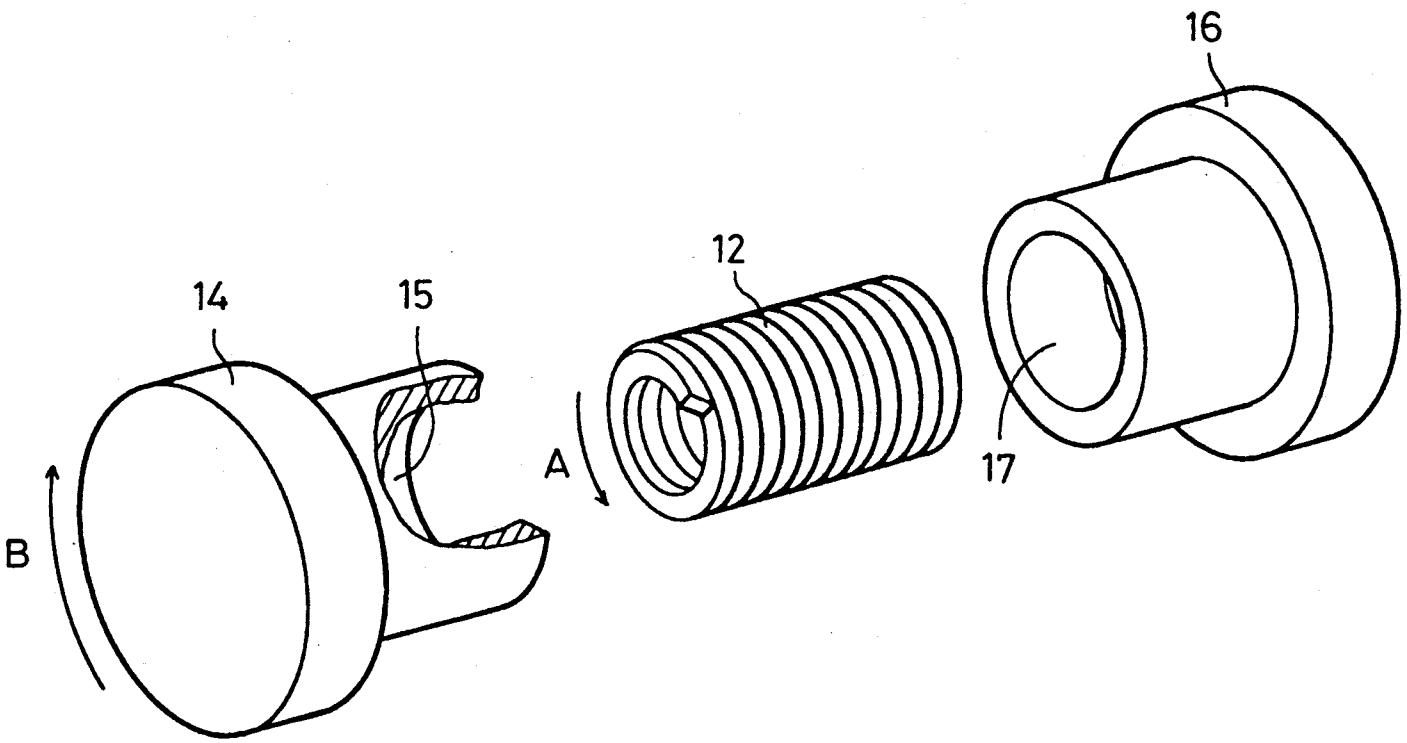
FIGS. 1 and 2 show how the coil spring works as a clutch.
Figure 2:
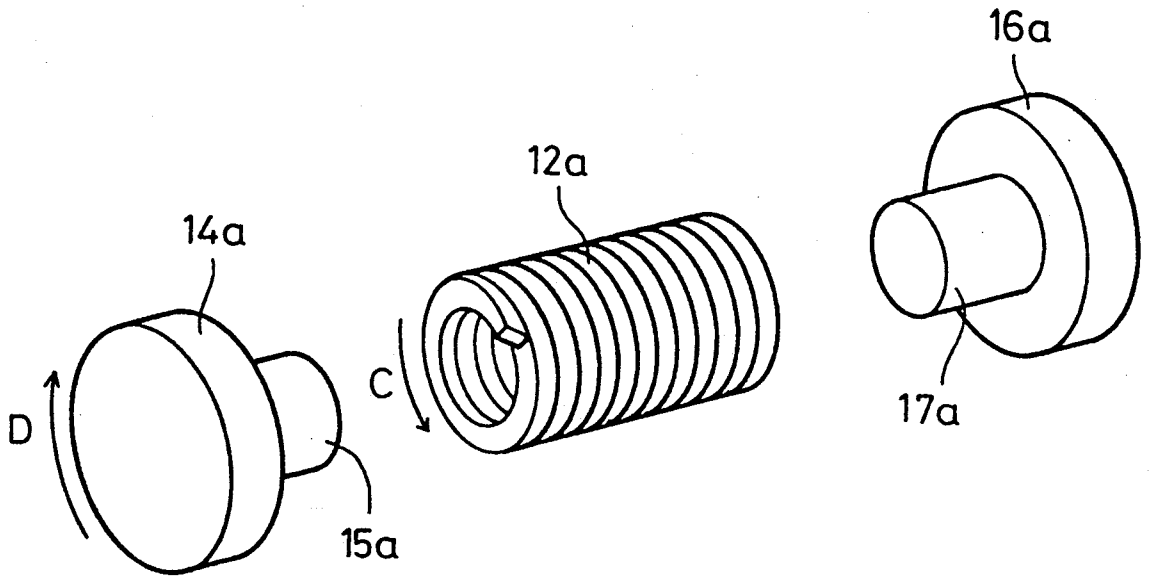

Please refer to FIGS. 1 and 2. FIGS. 1 and 2 illustrate the principle of a coil spring clutch. As shown in FIG. 1, a coil spring 12 is wound in the direction as denoted by an arrow A. One end of coil spring 12 is received in and slightly close fitted in a hole 15 of a driving wheel 11. The other end of coil spring 12 is received in and slightly close fitted in a hole 17 of a driven wheel 16. It the driving wheel 14 rotates along the direction denoted by an arrow B (the opposite direction of the winding direction of spring 12), then coil spring 12 will be urged to rotate with the driving wheel 14 and retract in its diameter so that the driven wheel 16 is disengaged with spring 12, therefore the driven wheel 16 will not rotate. Conversely, if the driving wheel 14 rotates along the opposite direction of arrow B (the same direction of the winding direction of spring 12), then coil spring 12 will be urged to rotate with the driving wheel 14 and be enlarged in its diameter so that the driven wheel 16 is engaged with spring 12, therefore the driven wheel 16 will rotate with the driving wheel 14.

As shown in FIG. 2, a coil spring 12*a* is wound in the direction as denoted by an arrow C. One end of coil spring 12*a* is sleeved on and slightly close fitted to one end 15*a* of a driving wheel 14*a*. The other end of coil spring 12*a* is sleeved on and slightly close fitted to one end 17*a* of a driven wheel 16*a*. If the driving wheel 14*a* rotates along the direction denoted by an arrow D (the opposite direction of the winding direction of spring 12*a*), then coil spring 12*a* will be urged to rotate with the driving wheel 14*a* and retract in its diameter so that the driven wheel 16*a* is engaged with spring 12*a*, therefore the driven wheel 16*a* will rotate with the driving wheel 14*a*. Conversely, if the driving wheel 14*a* rotates along the opposite direction of arrow D (the same direction of the winding direction of spring 12*a*), then coil spring 12*a* will be urged to rotate with the driving wheel 14*a* and be enlarged in its diameter so that the driven wheel 16*a* is disengaged with spring 12*a*, therefore the driven wheel 16*a* will not rotate.

Figure 3:
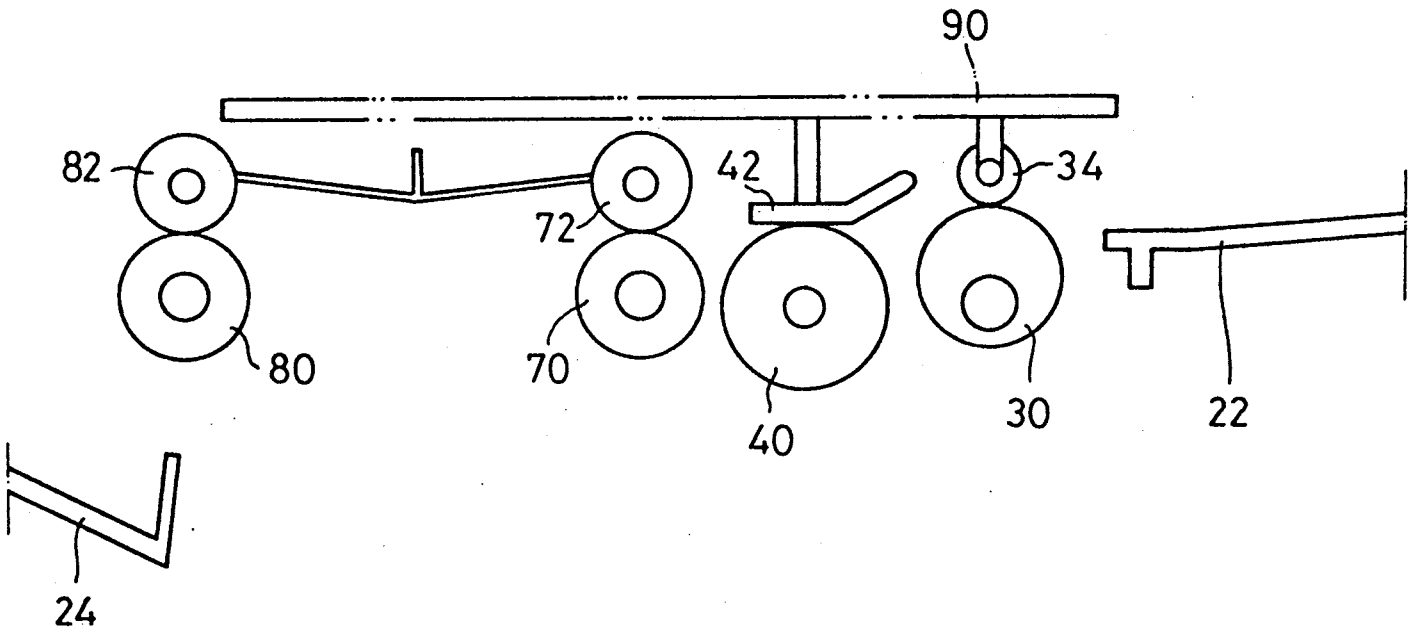
FIG. 3 shows the schematic side elevation of the automatic document feeder of the first embodiment of the present invention.
Figure 4:
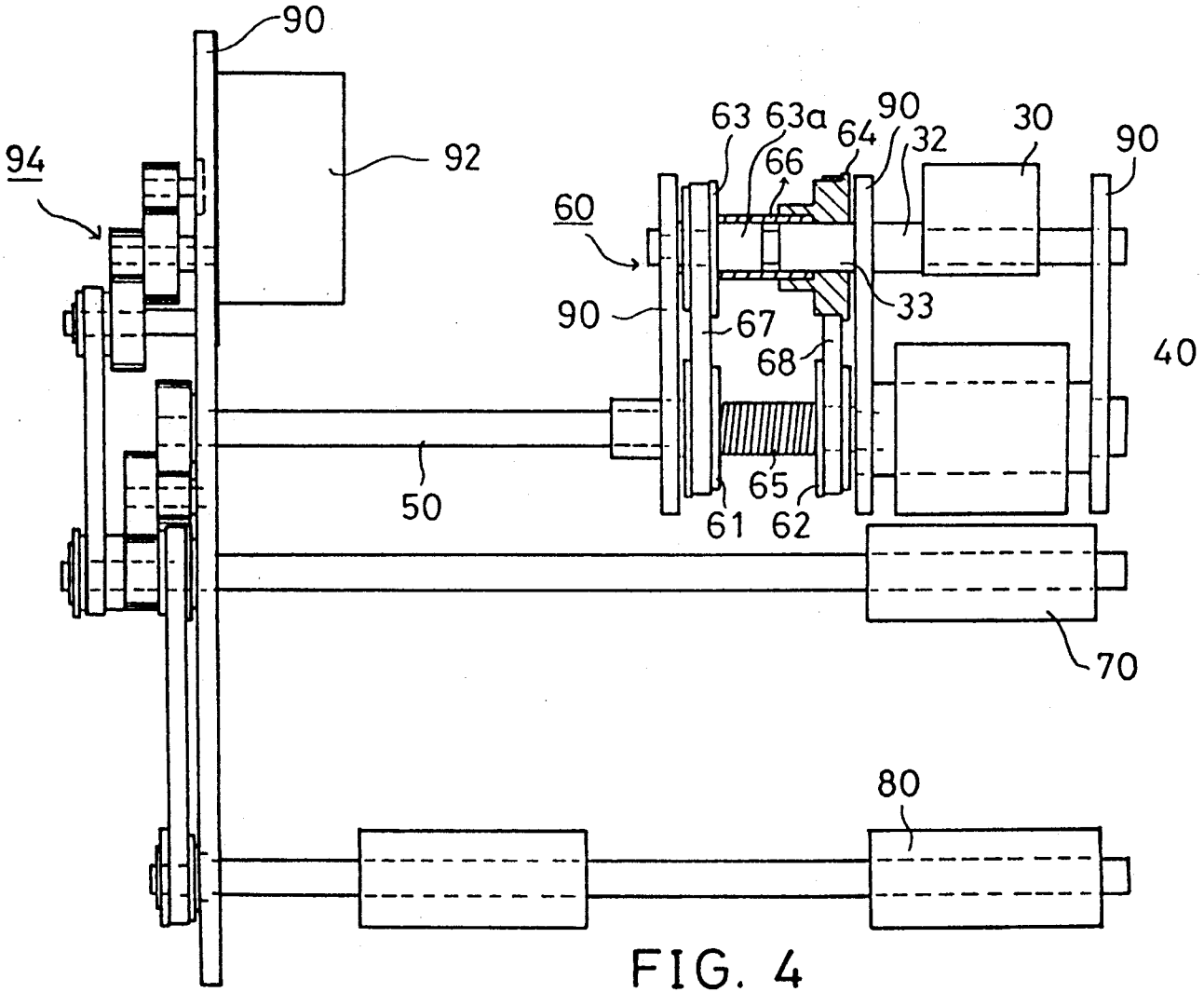
FIG. 4 shows the top elevation of the automatic document feeder of the first embodiment of the present invention.

Please refer to FIGS. 3 and 4. The automatic document feeder according to the present invention is adapted to transport document sheets from a document tray 22 to a downstream document outlet tray 24, for the fax machine to scan the graphical data on the document sheets and send out the data. The automatic document feeder has a feeding roller 30, a dividing roller 40, a driving shaft 50, a scanning roller 70, and an outlet roller 80. Feeding roller 30 is mounted on a shaft 32 which is disposed downstream the document tray 22, for urging the document sheets downstream. Dividing roller 40 is disposed downstream feeding roller 30. Dividing roller 40 receives the document sheets from feeding roller 30, then separates and urges one of the document sheets downstream. Driving shaft 50 is coaxially disposed with dividing roller 40. Scanning roller 70 is disposed downstream dividing roller 40. Scanning roller 70 receives the document sheet from dividing roller 40, and drives the document sheet at a constant speed so that the document sheet can be scanned accurately. Outlet roller 80 is disposed between scanning roller 70 and outlet tray 24. Outlet roller 80 receives the document sheet from scanning roller 70, and urges the document sheet downstream to the outlet tray.

The above mentioned members are all mounted or disposed on a frame 90 of the fax machine. A motor 92 and a transmission 94 are also mounted on the frame 90. Motor 90 drives driving shaft 50, scanning roller 70 and outlet roller 80 via transmission 94, as shown in FIG. 4. A feeding press roller 34, a scanning press roller 72 and a outlet press roller 82 are rotatably mounted on frame 90 as shown in FIG. 3. A dividing press pad 42 is disposed on frame 90. Feeding press roller 32, dividing press pad 42, scanning press roller 72 and outlet press roller 82 are all spring biased to press on feeding roller 30, dividing roller 40, scanning roller 70 and outlet roller 80 respectively, in order to facilitate smooth and precise paper transportation.

Figure 5:
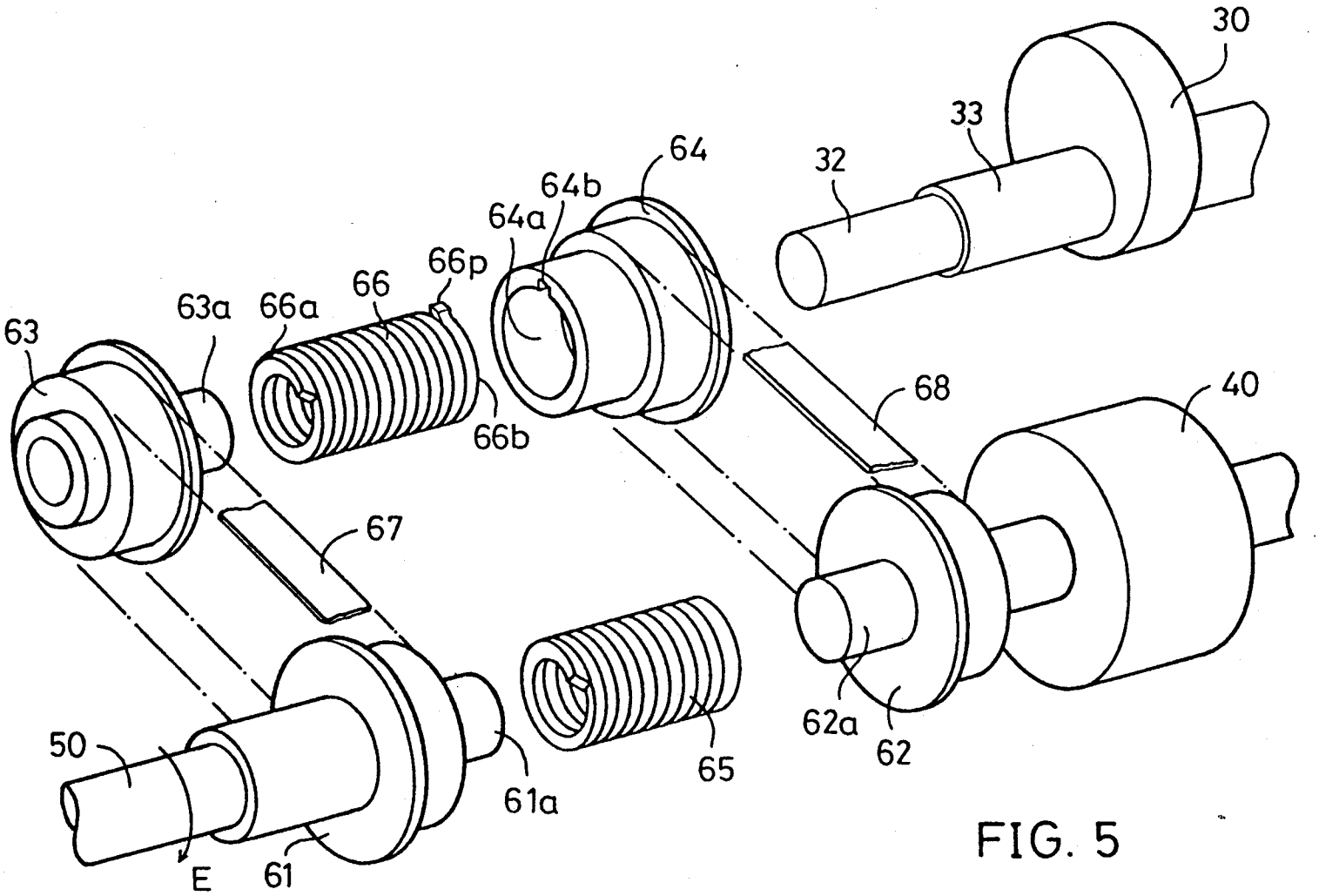
FIG. 5 shows the perspective exploded view of the automatic document feeder of the first embodiment of the present invention shown in FIG. 4.

Refer to FIG. 5, which shows the perspective exploded view of the clutch 60 of the first embodiment of the present invention. Clutch 60 is constructed by a first pulley 61, a second pulley 62, a third pulley 63, a fourth pulley 64, a first coil spring 65, a second coil spring 66, a first belt 67 and a second belt 68. The first pulley 61 is mounted on driving shaft 50 and rotate therewith. The first pulley 61 has an end portion 61*a*. The outer diameter of the end portion 61*a* is equal to the inner diameter of the first coil spring 65. The second pulley 62 is mounted on dividing roller 40 and rotates therewith. The second pulley 62 has an end portion 62*a*. The outer diameter of the end portion 62*a* is equal to the inner diameter of the first coil spring 65. One end of the first coil spring 65 is sleeved on and slightly close fitted to the end portion 61*a* of the first pulley 61. The other end of the first coil spring 65 is sleeved on and slightly close fitted to the end portion 62*a* of the second pulley 62. The winding direction of the first coil spring 65 is opposite to the rotational direction of driving shaft 50 (denoted by an arrow E). A bushing 33 is mounted on shaft 32. The outer diameter of bushing 33 is equal to the inner diameter of the second coil spring 66. The third pulley 63 is rotatably mounted on shaft 32. The third pulley 63 has an extended portion 63*a*. The outer diameter of the extended portion 63*a* is equal to the inner diameter of the second coil spring 66. The fourth pulley 64 is rotatably mounted on bushing 33. The fourth pulley 64 has a through hole 64*a*. Through hole 64*a* is in a coaxial relationship with the fourth pulley 64. Through hole 64*a* has a slot 64*b* thereon. The second coil spring 66 has a first end 66*a* and a second end 66*b*. The first end 66*a* of the second coil spring 66 is sleeved on and slightly close fitted to the extended portion 63*a*. The second end 66*b* of the second coil spring 66 has a protrusion 66*p*. The second end 66*b* is sleeved on and slightly close fitted to bushing 33 of shaft 32, and received in the through hole 64*a* of the fourth pulley 64. The protrusion 66*b* of the second coil spring 66 is received in the slot 64*b* of the fourth pulley 64, therefore the second coil spring 66 will rotate synchronously with the fourth pulley 64. The winding direction of the second coil spring 66 is opposite to the rotational direction of driving shaft 50. The first belt 67 is mounted on the first pulley 61 and the third pulley 63. The second belt 68 is mounted on the second pulley 62 and the fourth pulley 64. The diameters of the first pulley 61 and the third pulley 63 are equal. The diameters of the second pulley 62 and the fourth pulley 64 are equal. Consequently, the first pulley 61 and the third pulley 63 rotate at the same speed, and the second pulley 62 and the fourth pulley 64 rotate at the same speed, too. It should be noted that transmission 94 and scanning roller 70 and dividing roller 40 are so designed that the rotational speed of the outer periphery of scanning roller 70 is greater than that of dividing roller 40.

The operation of the first embodiment of the automatic document feeder according to the present invention will be discussed hereinbelow.

When the scanning operation begins, motor 92 urges the driving shaft 50, scanning roller 70 and outlet roller 80 to rotate via transmission 94. Driving shaft 50 urges the first pulley 61 to rotate. Because the rotational direction of the first pulley 61 (denoted by arrow E) is opposite to the winding direction of the first coil spring 65, the first coil spring 65 will be urged to retract in its diameter and clamp the outer periphery of the end portion 61*a* of the first pulley 61 and the outer periphery of the end portion 62*a* of the second pulley 62. Therefore, the second pulley 62 is engaged with the first pulley 61 via the first coil spring 65, and dividing roller 40 is urged to rotate with driving shaft 50. Simultaneously, the first pulley 61 drives the third pulley 63 via the first belt 67. Because the rotational direction of the third pulley 63 (indicated by arrow E) is opposite to the winding direction of the second coil spring 66, the second coil spring 66 is urged to retract in its diameter and clamp the outer periphery of the extended portion 63*a* of the third pulley 63 and bushing 33. Therefore, bushing 33 is engaged with the third pulley 63 via the second coil spring 66, and feeding roller 30 is urged to rotate with driving shaft 50. After that, the document sheets are transported to dividing roller 40 from the document tray 22 by feeding roller 30. One of the document sheets is urged downstream to scanning roller 70 by dividing roller 40. Scanning roller 70 urges the document sheet downstream at a greater speed because the outer periphery of scanning roller 70 runs faster than the outer periphery of dividing roller 40. Consequently, scanning roller 70 drags the document sheet and urges dividing roller 40 to rotate faster. As a result, since the second pulley 62 now rotates faster than the first pulley 61, the first coil spring 65 is enlarged in its diameter, and the second pulley 62 is disengaged from the first pulley 61. At the same time, the fourth pulley 64 is urged by the second pulley 62 to rotate faster. Since the fourth pulley 64 urges the second coil spring 66 to rotate faster than the third pulley 63, the second coil spring 66 is enlarged in its diameter, and feeding roller 30 is disengaged from the third pulley 63. Therefore feeding roller 30 stops and does not conflict the scanning operation. After the document sheet is scanned over, it is transported to the outlet tray 24. Consequently, dividing roller 40 slows down because it is not urged by scanning roller 70. After the rotational speed of dividing roller 40 is lower than that of the first pulley 61, dividing roller 40 and feeding roller 30 are respectively engaged with the first pulley 61 and the third pulley 63 again, another document sheet is transported to be scanned, and the above described steps are repeated, until no document sheets remain.

Figure 6:
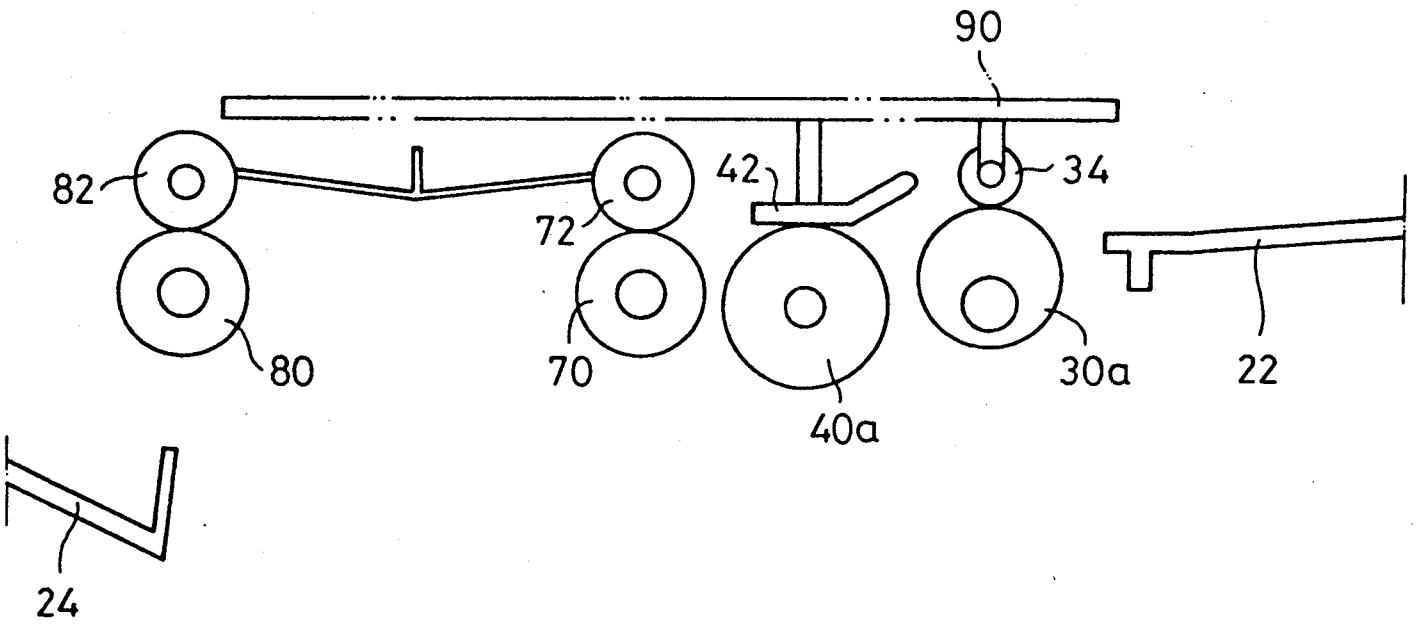
FIG. 6 shows the schematic side elevation of the automatic document feeder of the second embodiment of the present invention.
Figure 7:
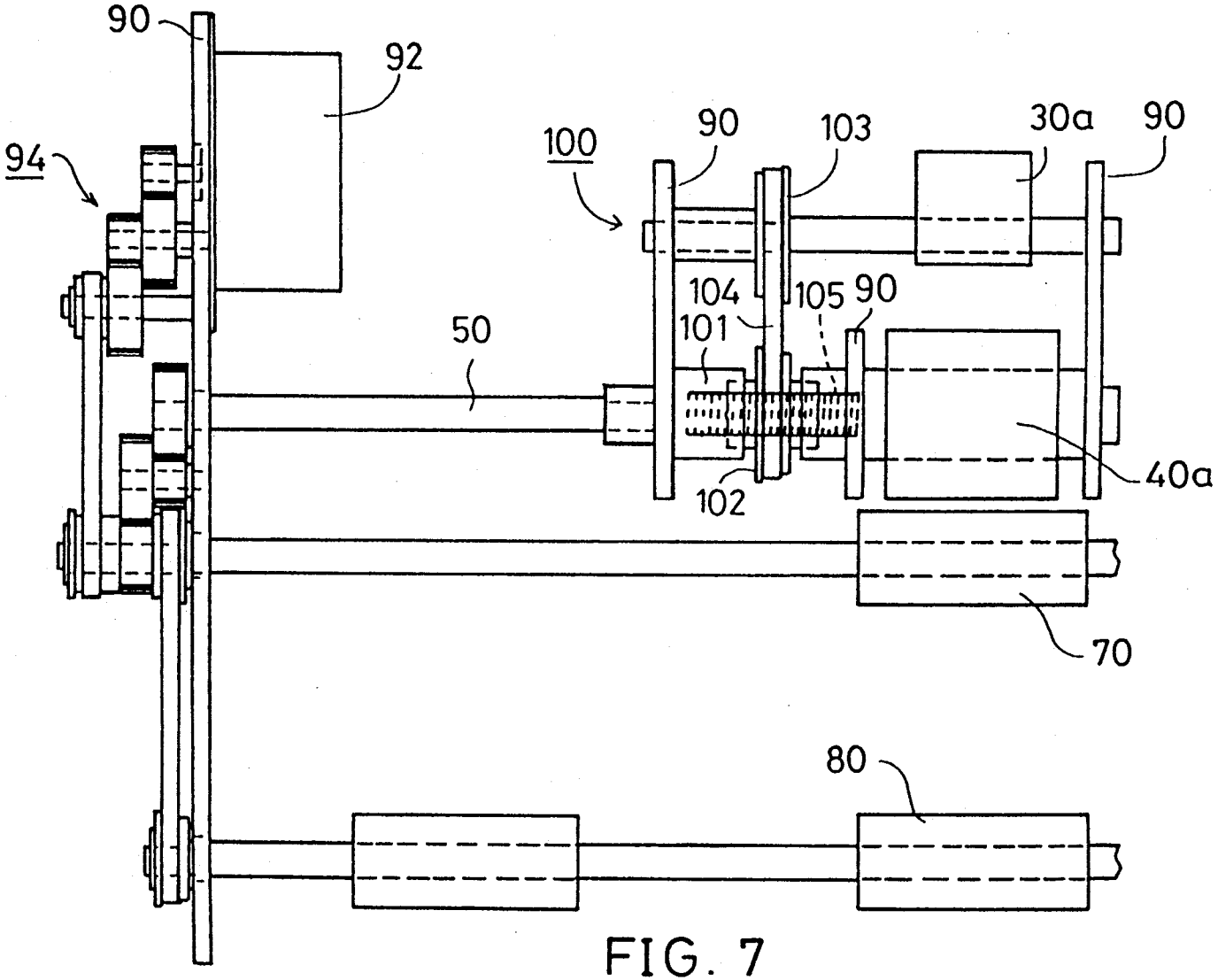
FIG. 7 shows the top elevation of the automatic document feeder of the second embodiment of the present invention.
Figure 8:
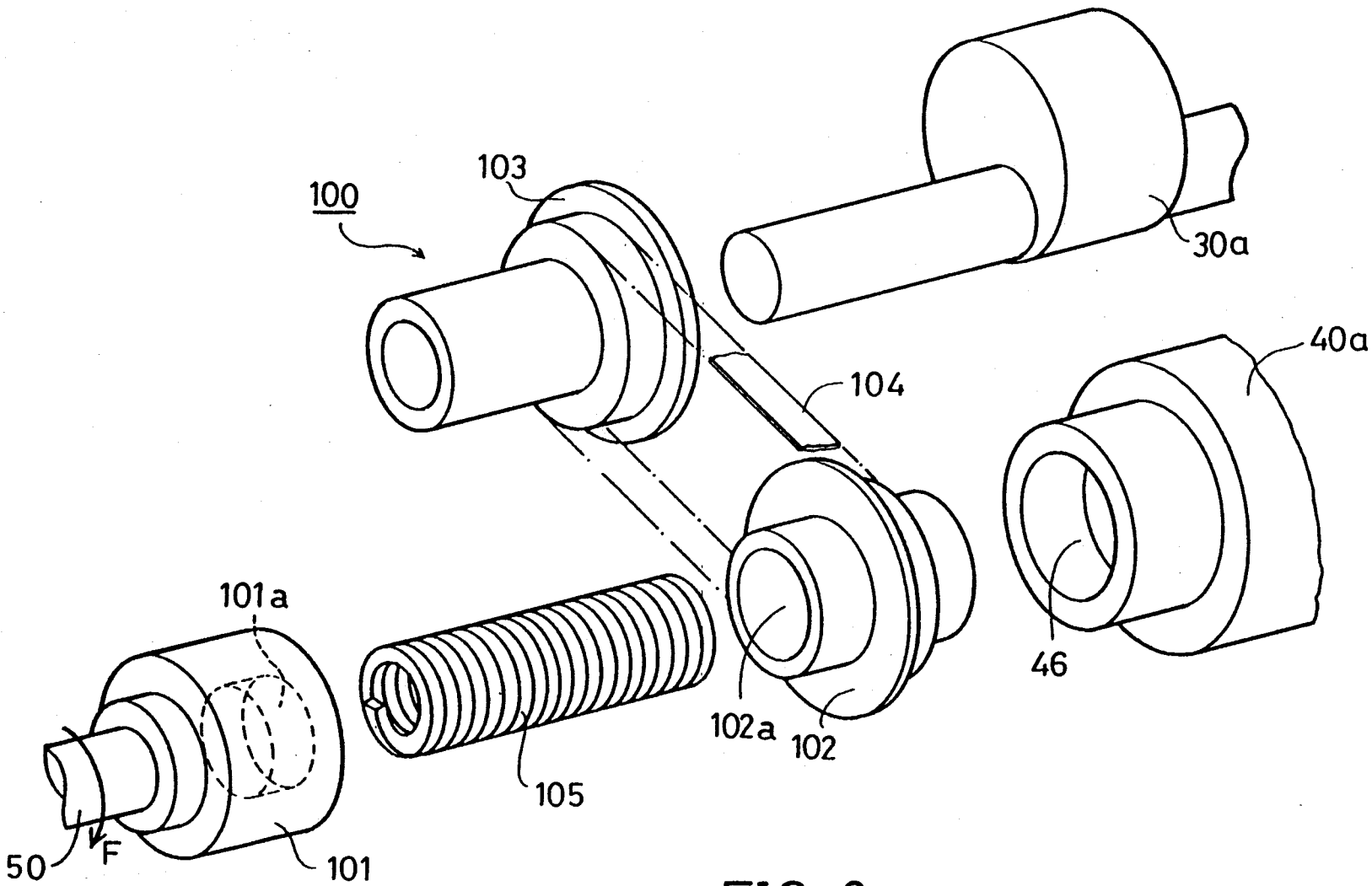
FIG. 8 shows the perspective exploded view of the automatic document feeder of the second embodiment of the present invention shown in FIG. 6.

The second embodiment of the present invention is shown in FIGS. 6, 7 and 8. The structure of the second embodiment is the same as the first embodiment except for the clutch 100. FIG. 8 shows the perspective exploded view of the clutch 100 of the second embodiment of the present invention. The clutch 100 consists of a socket 101, a first pulley 102, a second pulley 103, a coil spring 105 and a belt 104. Socket 101 is mounted on the driving shaft 50 and rotates therewith. Socket 101 has an hole 101*a* at its one end. The inner diameter of hole 101*a* is equal to the outer diameter of coil spring 105. The first pulley 102 has a coaxial through hole 102*a*. The inner diameter of through hole 102*a* is equal to the outer diameter of coil spring 105. The first pulley 102 is rotatably mounted on and slightly close fitted to coil spring 105 between socket 101 and dividing roller 40*a*. One end of dividing roller 40*a* has a hole 46. The inner diameter of hole 46 is equal to the outer diameter of coil spring 105. One end of coil spring 105 is received in and slightly close fitted to hole 46 of dividing roller 40*a*. The other end of coil spring 105 is received in and slightly close fitted to hole 101*a* of socket 101. The second pulley 103 is mounted on the feeding roller 30*a* and rotates therewith. The winding direction of coil spring 105 is the same as the rotational direction of driving shaft 50 (denoted by an arrow F). Belt 104 is mounted on the first pulley 102 and the second pulley 103. The diameters of the first pulley 102 and the second pulley 103 are equal. Consequently, the first pulley 102 and the second pulley 103 rotate in a same speed. It should be noted that the transmission 94 and the scanning roller 70 and dividing roller 40*a* are so designed that the rotating speed of the outer periphery of scanning roller 70 is greater than that of dividing roller 40*a*.

The operation of the second embodiment of the automatic document feeder according to the present invention will be discussed hereinbelow.

When the scanning operation begins, motor 92 urges the driving shaft 50, scanning roller 70 and the outlet roller 80 to rotate via transmission 94. Driving shaft 50 urges socket 101 to rotate. Because the rotational direction of socket 101 (denoted by arrow F) is the same as the winding direction of coil spring 105, coil spring 105 will be enlarged in its diameter, and the first pulley 102 and dividing roller 40*a* are engaged with coil spring 105. Therefore, dividing roller 40*a* and the first pulley 102 are urged to rotate with driving shaft 50. Simultaneously, the first pulley 102 drives the second pulley 103 and the feeding roller 30*a* via the belt 104. After that, the document sheets are transported to dividing roller 40*a* from the document tray 22 by feeding roller 30*a*. One of the document sheets is urged downstream to scanning roller 70 by dividing roller 40*a*. Scanning roller 70 urges the document sheet downstream at a greater speed because the outer periphery of scanning roller 70 runs faster than the outer periphery of dividing roller 40*a*. Consequently, scanning roller 70 drags the document sheet and urges dividing roller 40*a* to rotate faster. As a result, coil spring 105 is urged to retract in its diameter, and the first pulley 102 and dividing roller 40*a* are disengaged from socket 101. Therefore the feeding roller 30*a* stops and does not conflict with the scanning operation. After the document sheet is scanned over, it is transported to the outlet tray 24. Consequently, dividing roller 40*a* slows down because it is not urged by scanning roller 70. After the rotational speed of dividing roller 40*a* is lower than that of socket 101, dividing roller 40*a* and the feeding roller 30*a* engages with socket 101 again, another document sheet is transported to be scanned, and the above described steps are repeated, until no document sheets remain.

While the invention has been described by way of example and in terms of several preferred embodiments, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. An automatic document feeder of a fax machine, for transporting document sheets from a document tray to an outlet tray, during which the graphical data on the document sheets is scanned and transmitted, comprising:

a frame;

a feeding roller, disposed on said frame downstream the document tray, for urging the document sheets downstream;

a dividing roller, disposed on said frame downstream said feeding roller, for urging one of the document sheets downstream, said dividing roller having a first outer periphery;

a driving shaft, coaxially disposed with said dividing roller on said frame;

a scanning roller, disposed on said frame downstream said dividing roller, for urging said one of the document sheets downstream, while said one of the document sheets being scanned, said scanning roller having a second outer periphery;

an outlet roller, disposed on said frame downstream said scanning roller and upstream the outlet tray, for transporting said one of the document sheets to the outlet tray;

means for urging said driving shaft and said scanning roller and said outlet roller, so that the tangential speed of said second outer periphery of said scanning roller is greater than the tangential speed of said first outer periphery of said dividing roller; and a clutch, connecting said driving shaft and said feeding roller and said dividing roller, for controlling the rotation of said feeding roller and said dividing roller, said clutch comprising a first pulley, a second pulley, a third pulley, a fourth pulley, a first coil spring, a second coil spring, a first belt and a second belt, said first pulley being mounted on said driving shaft, said second pulley being mounted on said dividing roller, said first coil spring being wound in the opposite direction of the rotational direction of said driving shaft, one end of said first coil spring being sleeved on and slightly close fitted to said first pulley and the other end being sleeved on and slightly close fitted to said second pulley, said third pulley being rotatably mounted on said feeding roller, said fourth pulley being rotatable mounted on said feeding roller, said fourth pulley having an enlarged hole at one end of said fourth pulley, said enlarged hole of said fourth pulley having a periphery and a slot which extends axially along said periphery of said enlarged hole of said fourth pulley, said second coil spring having two ends and a protrusion at one of said two ends of said second coil spring, said second coil spring being wound in the opposite direction of the rotating direction of said third pulley, said one end of said second coil spring being received in said enlarged hole of said fourth pulley and being simultaneously sleeved on and slightly close fitted to said driving roller, said protrusion of said second coil spring being received in said slot of said fourth pulley and the other end of said second coil spring being sleeved on and slightly close fitted to said third pulley, said first belt being mounted on said first pulley and said third pulley, said second belt being mounted on said second pulley and said fourth pulley.

* * * * *